US010930145B2

(12) United States Patent
Yuasa

(10) Patent No.: US 10,930,145 B2
(45) Date of Patent: Feb. 23, 2021

(54) TRAFFIC SYSTEM FOR PREDICTING AND PROVIDING TRAFFIC SIGNAL SWITCHING TIMING

(71) Applicant: Avanti R&D, Inc., Torrance, CA (US)

(72) Inventor: Go Yuasa, Rancho Palos Verdes, CA (US)

(73) Assignee: Avanti R&D, Inc., Torrance, CA (US)

( * ) Notice: Subject to any disclaimer, the term of this patent is extended or adjusted under 35 U.S.C. 154(b) by 0 days.

(21) Appl. No.: 16/805,791

(22) Filed: Mar. 1, 2020

(65) Prior Publication Data

US 2020/0286371 A1 Sep. 10, 2020

Related U.S. Application Data

(60) Provisional application No. 62/955,809, filed on Dec. 31, 2019, provisional application No. 62/814,790, filed on Mar. 6, 2019.

(51) Int. Cl.

| | |
|---|---|
| ***G08G 1/01*** | (2006.01) |
| ***G08G 1/08*** | (2006.01) |
| ***G08G 1/052*** | (2006.01) |
| ***G08G 1/015*** | (2006.01) |

(52) U.S. Cl.

CPC ..... *G08G 1/0141* (2013.01); *G08G 1/015* (2013.01); *G08G 1/0116* (2013.01); *G08G 1/052* (2013.01); *G08G 1/08* (2013.01)

(58) Field of Classification Search

CPC ..... G08G 1/0141; G08G 1/0116; G08G 1/015

See application file for complete search history.

(56) References Cited

U.S. PATENT DOCUMENTS

| | | | | |
|---|---|---|---|---|
| 7,398,076 | B2 | 7/2008 | Kubota | |
| 9,418,546 | B1 | 8/2016 | Whiting | |
| 2014/0277986 | A1* | 9/2014 | Mahler | G08G 1/0116 701/93 |
| 2015/0029042 | A1 | 1/2015 | Ikeya | |
| 2018/0365991 | A1* | 12/2018 | Yamanoi | G06K 9/00818 |
| 2020/0066148 | A1* | 2/2020 | Werner | G08G 1/096791 |
| 2020/0160072 | A1* | 5/2020 | Slater | G06K 9/00825 |

* cited by examiner

*Primary Examiner* — Hongmin Fan

(74) *Attorney, Agent, or Firm* — Baba Patent Agency

(57) ABSTRACT

A traffic system for predicting a traffic signal switching timing comprises a camera sensor including a) a camera for capturing images of traffic signal lights along a traffic lane, b) a CPU for running computer programs for analyzing the images of the traffic signal lights and the moving objects, wherein the traffic signal switching timing includes a yellow, red and green lighting time of each the traffic signal lights, c) a sound sensor for obtaining sound signals originated from the moving objects, and d) a communication interface for sending and receiving data associated with the traffic signal switching timing to/from other camera sensors; and a server for providing traffic information including the traffic signal switching timing to drivers of the moving objects, the sever being arranged to receive and sends the data to/from the camera sensor.

12 Claims, 5 Drawing Sheets

TRAFFIC SYSTEM FOR PREDICTING AND PROVIDING TRAFFIC SIGNAL SWITCHING TIMING

This non-provisional application claims priority from U.S. Provisional Patent Application Ser. No. 62/814,790 filed, Mar. 6, 2019 and U.S. Provisional Patent Application Ser. No. 62/955,809 filed, Dec. 31, 2019, the contents of which are incorporated herein by reference in its entirety.

BACKGROUND OF THE INVENTION

Technical Field

The present invention relates to a technical field of a traffic system for predicting and providing traffic signal switching timing to drivers of vehicles on road lanes.

Description of Related Art

U.S. Pat. No. 7,398,076 discloses following technologies. When a vehicle is approaching a traffic signal lights, a camera installed inside a navigation system in the vehicle captures images of traffic signal lights disposed on the traffic signal to produce traffic signal information including traffic signal control pattern of the traffic signal in each plurality of time zone.

In this case, the traffic signal information is collected by a navigation system in a plurality of vehicles on the road lanes and stored in a sever via network. Then, a plurality of vehicles uses collected traffic signal information memorized in the server. Accordingly collected traffic information is historical data gathered by the camera inside the vehicle in a past when the car has been driven around the traffic areas concerned. When the driver drives a vehicle at an area where the driver has not frequently visited, it is difficult to obtain updated traffic signal information.

Thus, there is a need to provide updated traffic signal information provided by public traffic infrastructure.

SUMMARY OF THE INVENTION

The forgoing objective of the present invention is accomplished by an embodiment of a traffic system for predicting a traffic signal switching timing, the traffic system including a camera sensor having a camera identification code (CID), the camera sensor including a) a camera for capturing images of traffic signal lights along a traffic lane and moving objects on the traffic lane, b) a CPU for running computer programs for analyzing the images of the traffic signal lights and the moving objects to learn traffic signal switching timing, wherein the traffic signal switching timing includes time stamps when traffic signal changes from green to yellow, a yellow lighting time being a duration time of yellow light, a red lighting time being a duration time of red light and a green lighting time being a duration time of green lighting time of each traffic signal lights, c) a sound sensor for obtaining sounds originated from the moving objects, and d) a communication interface for sending and receiving data associated with the traffic signal switching timing with the camera identification code (CID) to/from other camera sensors; and a server for providing traffic information including the traffic signal switching timing to drivers of the moving objects, the sever being arranged to receive and sends the data to/from the camera sensor.

The forgoing objective of the present invention is also accomplished by another embodiment of the traffic system of described above, wherein the server is arranged to store the camera identification code (CID), the time stamp when traffic light changes from green to yellow (Time Stamp), the yellow lighting time, the red lighting time and the green lighting time.

By using this embodiment, the traffic signal information can be obtained through infrastructure including the server associated road traffic systems not depending on a sensor system including a camera installed inside vehicles. As a result, it becomes possible to realize cooperation on traffic signal information obtained by the infrastructure associated with road traffic systems and GPS system installed in the vehicle or smart phones including cellular phones.

There is a possibility that a quick acceleration or deceleration is needed when the vehicles are approaching traffic lights if no traffic information available. It becomes possible to smoothly drive the vehicle because traffic light switching timing is available to drivers of the vehicle. The above-described embodiment capable of providing information indicating whether to accelerate or decelerate the vehicle when the vehicle is approaching a signal. Additionally, the traffic system provides information about a predicted waiting time at a red signal.

It is beneficial to provide a traffic system for producing signal information for predicting the current status of a traffic signal as described above.

DETAILED DESCRIPTION OF THE INVENTION

Hereinafter, embodiments of the present invention will be described with reference to the accompanying drawings. It is well known that it becomes possible to save fuel consumption and improve gasoline mileage by reducing unnecessary acceleration and deceleration of vehicle by knowing traffic light switching timing of traffic signals, which contribute reducing traffic jam on the road.

Figure 1:
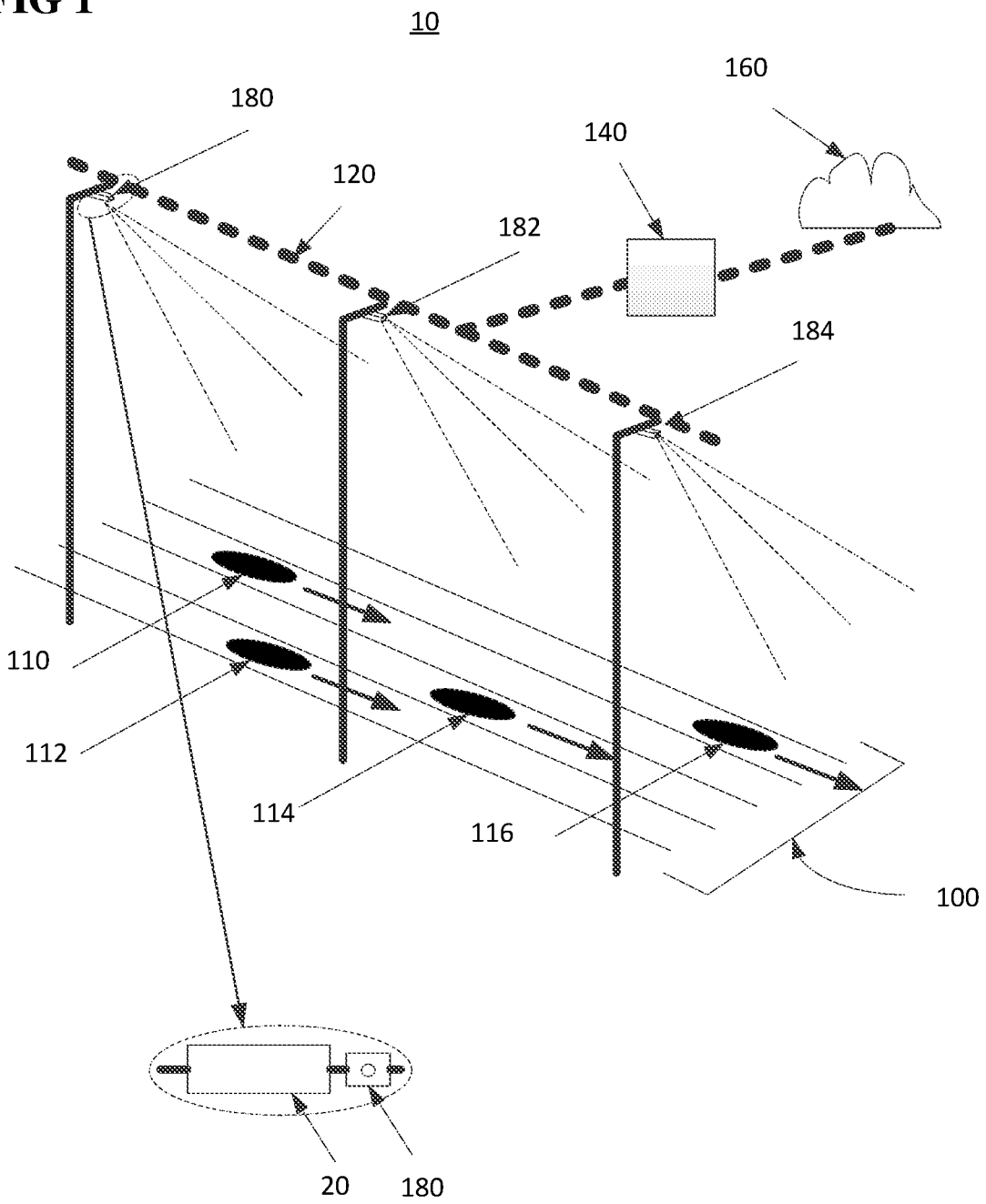
FIG. 1 illustrates a traffic system for predicting traffic signal switching timing including a plurality of camera sensors arranged to capture traffic signals lights and moving objects on the road lanes, the camera sensor being linked to other camera sensors.

FIG. 1 illustrates a traffic system 10 for predicting traffic signal switching timing including a plurality of camera sensors 180, 182 and 184, and server 160 linked to camera sensors 180, 182 and 184 through a gateway 140 via mesh network 120. Camera sensors 180, 182 and 184 are arranged to capture images of traffic lights provided along load lane 100, moving objects 110, 112, 114 and 116, such as buses, trucks, cars, motorcycles, bicycles, pedestrians etc., on the road lanes 100.

Camera sensor 180 is attached on a pole as illustrated in a magnified figure denoted in a dotted circle in FIG. 1. In this case, camera sensor is attached on the same pole to which traffic lights 20 is attached as illustrated in FIG. 1, but not limited to this. Camera sensor 180 can be attached other structures, such as poles along the load lane 100 if the camera sensor 180 can capture the images of traffic lights and moving objects on the road lanes. Camera sensors 180, 182 and 184 are deployed adjacent to the traffic lights provided along road lane 100. In FIG. 1, camera sensor 180 is arranged to capture images of traffic lights facing to the camera sensor 180 which can be seen by drivers of moving objects 110 and 112, in this figure. Arrows illustrated in FIG. 1 show moving direction of the moving objects 110-116.

The captured images are analyzed in each camera sensor 180, 182 and 184. Analyzed data with a camera identification (CID) are transmitted to server 160 via gateway 140. The captured images are analyzed at each camera sensor to classify into several classes of moving objects, such as, buses, trucks, cars, motorcycles, bicycles, pedestrians etc., by the computer programs running in each camera sensor of the camera sensors 180, 182 or 184.

Figure 2:
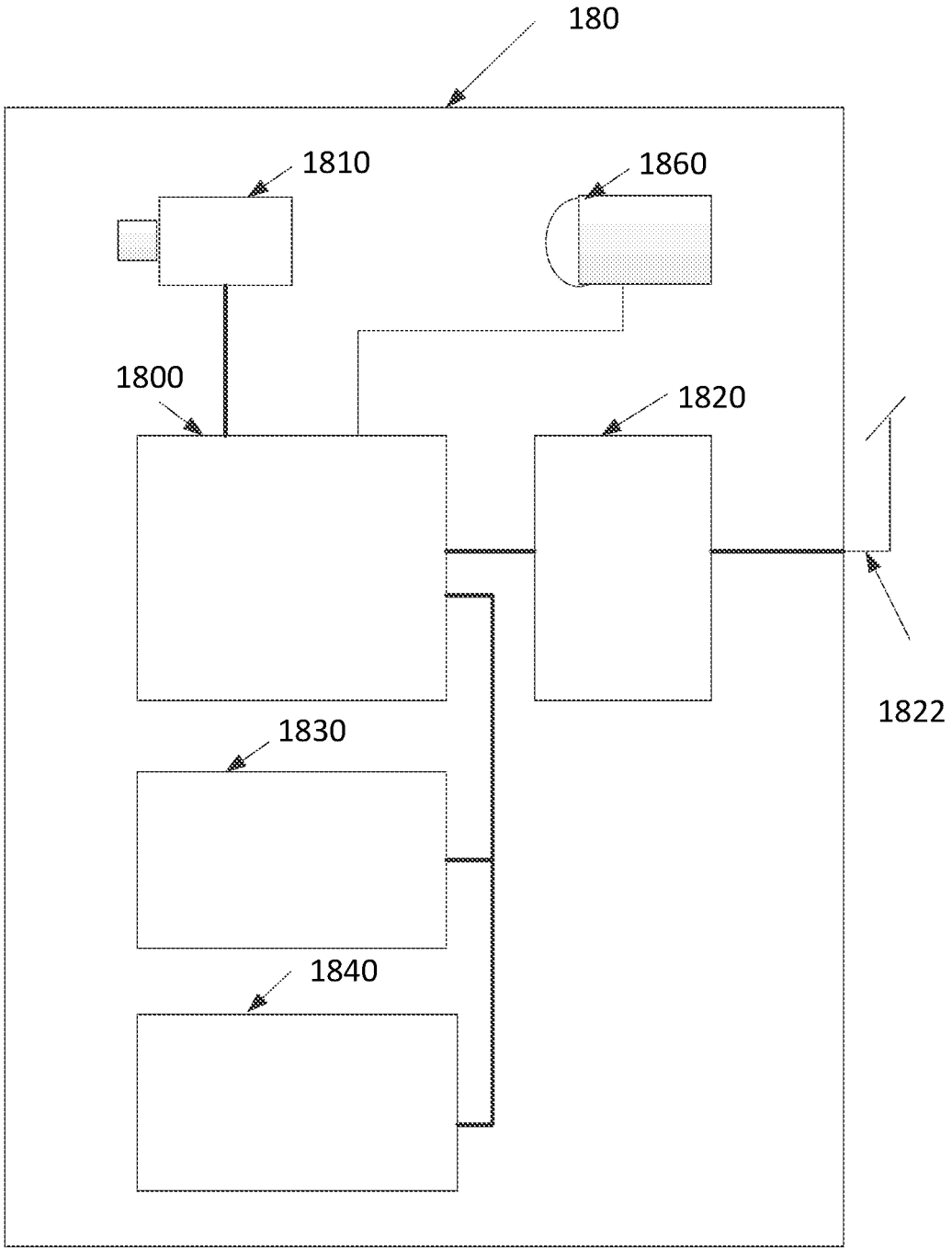
FIG. 2 illustrates a configuration of camera sensor.

FIG. 2 illustrates a configuration of camera sensor 180. The camera sensor 180 is configured by a camera 1810, a sound sensor 1860, a CPU 1800, communication interface 1820, Read only Memory (ROM) 1830, Random Access Memory (RAM) 1840 and antenna 1822 as illustrated in FIG. 2. Camera 1810 is arranged to capture images of traffic signal lights, moving objects on a road lane, a loop coil for sensing vehicles to switch the traffic signal lights when moving objects reach on the loop coil. Sound sensor 1820 is to pick up sound and noise signals mainly originated from moving objects on the road lane. CPU (Center Processing Unit) or GPU (Graphic Processing Unit) or combination thereof 1800 runs computer programs stored in ROM. RAM 1840 is arranged to temporally store data including image data captured by the camera 1810, sound data captured by the microphone 1860 and data associated with the computer programs. Antenna 1822 is designed to send and receive data from or/to sever 160 and other camera sensors 182 and 184 via gateway 140.

Embodiment 1

Predicting Traffic Light Change Timing

The computer programs running on the CPU 1800 installed in the camera sensor 180 include functions for further obtaining speed of each moving objects based on a moving time and a distance between two locations where cameras 180 and 182, for example, by identify the same moving objects passing through both locations based on the captured image data at both locations. The program running on the CPU 1800 has functions for giving the same identification code (Re-ID) on two moving objects when the program identifies that two moving objects are the same or close enough based on the color, shape, classification of the moving object.

Further, camera sensors 180, 182 and 183 are arranged to capture images of traffic signal lights whose images are captured by each camera sensor. Then, the computer programs running on the CPU 1800 in the camera sensor recognizes the color of traffic lights. The order of traffic light colors changes from Green to Yellow, Yellow to Red and Red to Green which is common in worldwide. Thus, it becomes possible to predict the time when the traffic light (Yellow) changes to (Red) by learning durations of each traffic light (Green, Yellow and Red) and the time when traffic light changes, in advance. In this embodiment, the camera sensors 180 182 and 184 are set near traffic signal lights as illustrated in FIG. 1. Camera sensors 180, 182 and 184 are arranged to further capture traffic signals together with moving objects on the traffic lanes and the captured images are analyzed by the CPU 1800 on each camera sensor 180, 182 or 184 (Edge computing) to learn the traffic light change timings based on the images captured by camera 1810. These captured images are analyzed by each camera sensor 180, 182 or 184. Then analyzed traffic data including traffic signal light change timing, number of moving objects and speed of the moving objects are transmitted to server 160 via gateway 140 to update the data stored in the server 160 so that the data stored in the server is always updated according to the traffic condition on each lane of the road. These traffic data stored in the server is arranged to be accessed by drivers on the vehicles running on the road. At the same time, each camera sensor 180, 182 or 184 learns traffic signal change timing. When the traffic signal change timing unexpectedly changes due to power down, for example, each camera sensor 180, 182 or 184 is arranged to send a trigger signal to the server 160 to let the server 160 knows that the traffic signal change timing of a specific traffic signal light has been changed and the new traffic signal change timing is updated.

When there is provided loop coils for detecting vehicles on the loop coils, the programs running on the CPU 1800 in the camera sensor 180 recognize that a vehicle has stopped on the loop coils by using analyzed images capture by the camera sensors 180 and predicts when the traffic lights change. In this case, since the captured images of moving object are analyzed for each road lane, traffic signal change timing can be predicted for each road lane, for example, go-straight, turn-light and turn-left.

Embodiment 2

Re-ID and Moving Object Travel Route

In another embodiment, the programs running on the CPU 1800 in the camera sensor 180 are arranged to predict the time when a moving object reaches to the next the traffic signal and the time when the traffic light changes to Green by calculating the time to the next traffic light based on Re-ID which will be described as followings.

Re-ID technology is technology for assigning the same ID to two moving objects when having recognized the same moving objects between different camera sensors so that the moving object can be tracked between two location where different cameras sensors are set.

Computer programs assign an anonymous ID to moving objects (vehicles, bicycles, pedestrians, etc.) that pass in front of camera sensor 180, 182 or 184, and provides characteristic information, such as a shape, color, etc., of a moving object and a time stamp when the moving object passes through the location where the camera sensor is set. Then, computer programs on a camera sensor send the anonymous ID with characteristic information described above to adjacent sensors. Other camera sensor waits for the same object to pass by referring to the anonymous ID and the characteristic information from another sensor. If the same object can be detected that those traffic data are sent to sever 160 at the appropriate time together with a time stamp. In the server 160, the information and the number of vehicles traveling on both camera sensors can be grasped from the information.

Re-ID technology is to generate a unique ID (Identification Code) by extracting features, such as a shape, or colors of moving object and assign the unique ID to the moving object. Since the unique ID is shared by adjacent camera sensors via communication channels between camera sensors, the camera sensors can determine whether the moving object is the same moving object or not. By using this technology, when the moving object is determined to be the same moving object, it becomes possible to know the moving time between two locations and the moving route without involvement of server.

Embodiment 3

Traffic Data Related to Traffic Signal Timing

Traffic data transmitted from camera sensor to server 160 via the gateway 140 is as follows:

Camera Sensor ID (CID)

Time stamp when traffic light changes from Green to Yellow (Time Stamp)

Lighting time of Yellow (Duration time of Yellow being changed to Red); Yellow Time Lighting time of Red (Duration time of Red being changed to Green); Red Time [s])

Lighting time of Green (Duration time of Green being changed to Yellow); Green Time [s])

Triger signals for updating traffic information

Traffic data provided by server 160 to drivers and administrators is as follows Traffic light locations (the traffic signal point is determined by camera ID.

Timing when the traffic signal changes to Red (Time Stamp+Yellow Time [s])

Timing when the traffic signal changes to Green (Time Stamp+Yellow Time+Red Time [s])

Data above are examples and not limited to these. Number of moving objects on each location where camera sensor is deployed and other traffic data described above can be sent to server 160.

According to an embodiment of the present invention, images captured by the camera 1810 is analyzed in the camera sensor 180. Accordingly, data size on mesh network can be limited to small so that communication load on the network can be light. As a results high-speed communication can be realized on the traffic system which is very important for traffic system.

From vehicle driver's point of view, when accessing the traffic data provided by the traffic server, the driver can obtain the traffic signal switching timing in advance, the driver can adjust the speed of the vehicle so that it becomes possible to save gasoline consumption of the vehicle.

Embodiment 4

Sensor for Obtaining Sound Signals—Sound Sensors

In FIG. 2, there is provided a sound sensor 1860 for picking up sound and noise signals originated from moving objects on the road lanes in camera sensor 180 in this embodiment. These sound and nose signals originated from moving objects on the road lanes are used to identifying an engine type of a moving object behind a large moving object such as big trucks and buses on the road. For example, a compact car behind big a truck cannot be captured by camera 1810.

Sound signals originated from a vehicle behind a big truck or a bus can be used to recognize the vehicle behind the a big moving object by utilizing sound signal originated from the vehicle behind the big moving object once an engine sound signal shape and a frequency range associates with the vehicle have been learned in advance. For example, sound differences between a diesel engine and a gasoline engine, which cannot be identified by capturing images by camera 1810, will be identified by utilizing sound signals captured by sound sensor 1860.

In order to analyze and determining an engine type of a moving object using audible sound signals originated from moving objects, pre-learning of specific sound signal shapes and frequency ranges of the specific sound are required to classify a moving object without images of the moving object. Motorcycles, diesel engines, gasoline engines have their specific engine sound wave form having specific frequency ranges. Further, running noise created by the road surface and tires of wheels of a vehicle, which changes depending on weather conditions, such as fine days, rainy days and snowy days, may be learned in advance so that detailed sound analysis becomes available. By using these specific sound data obtained by sound sensor 1860, it becomes possible to identify a moving object behind a big moving object.

Further, sound sensor 1860 is used to measure noise pollution levels associated with moving objects on the road lanes. Sound signals emitted from moving objects on the road lanes have become public problems not only in developed countries but also less developed countries. Sound signals obtained by sound sensor or a microphone 1860 are analyzed to search the main causes of the noise pollution and to find the solution to decrease the noise polluting levels to provide recommendations for protecting human health from exposure to environmental noise originating from various moving objects on the road.

Embodiment 5

Computer Programs

Figure 3:
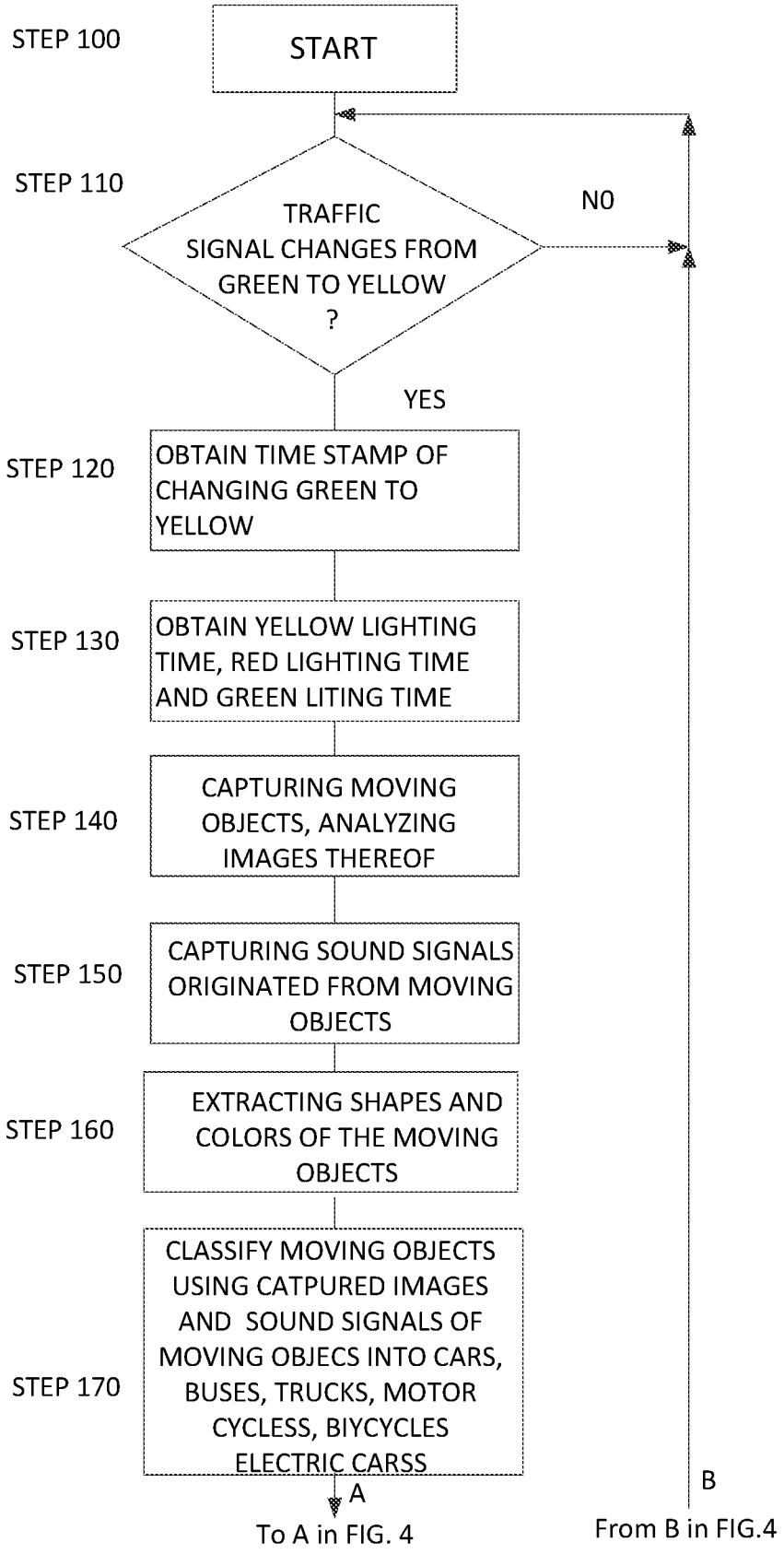
FIG. 3 illustrates a flowchart of computer programs running on CPUs on a camera sensor in a traffic system.

FIG. 3 illustrates a flowchart of computer programs running on CPU 1800 on a camera sensor 180 in a traffic system 10. Each camera sensor 180, 182 or 184 includes computer programs for analyzing images of traffic lights, images of moving objects on each road lane 100 captured by camera 1810 and sound signals originated from moving objects obtained by sound sensor 1860, and controlling communications via communication interface 1820 with other camera sensors to exchange traffic data and uploading traffic data to server.

The computer programs include functions for analyzing captured images of traffic signal lights to obtain traffic signal change timing from Green to Yellow. Once, computer programs recognize this traffic signal change timing from Green to Yellow, STEP 110, then obtain the time when this traffic light color change occurs (time stamp), STEP 120. Computer programs, then, obtain Yellow lighting time, Red lighting time and Green lighting time so that each camera sensor knows the traffic light change timings of traffic lights captured by the camera sensor 180, 182 or 184, STEP 130.

Then, the computer programs analyze captured images of moving objects moving on the road lanes 100, STEP 140. Further computer programs include functions for capturing and analyzing sound signals originated from moving objects, STEP 150. Captured sound signals are useful to detect a moving object behind large vehicles, which cannot be recognized by a camera. In order to analyze sound signals, reference sound signals to compare with is necessary. These reference-sound-signals need to be captured in advance. Features of reference-sound-signals, such as frequency ranges and specific sound wave forms need to be extracted from captured reference-sound-signals to obtain reference-sound-signals, such as sounds of engines of motorcycles, electric vehicles, gasoline engines under different weather conditions as described above.

Computer programs, then, extract shapes and color of the moving objects to detect the models of the vehicle, makers and types of vehicles, STEP 160. Then, computer program classifies the moving objects into cars, buses, trucks, motorcycles, bicycles and pedestrians. If necessary, captured sound signals captured by sound sensor 1860 can be supplementary used to classify moving objects, STEP 170.

Figure 4:
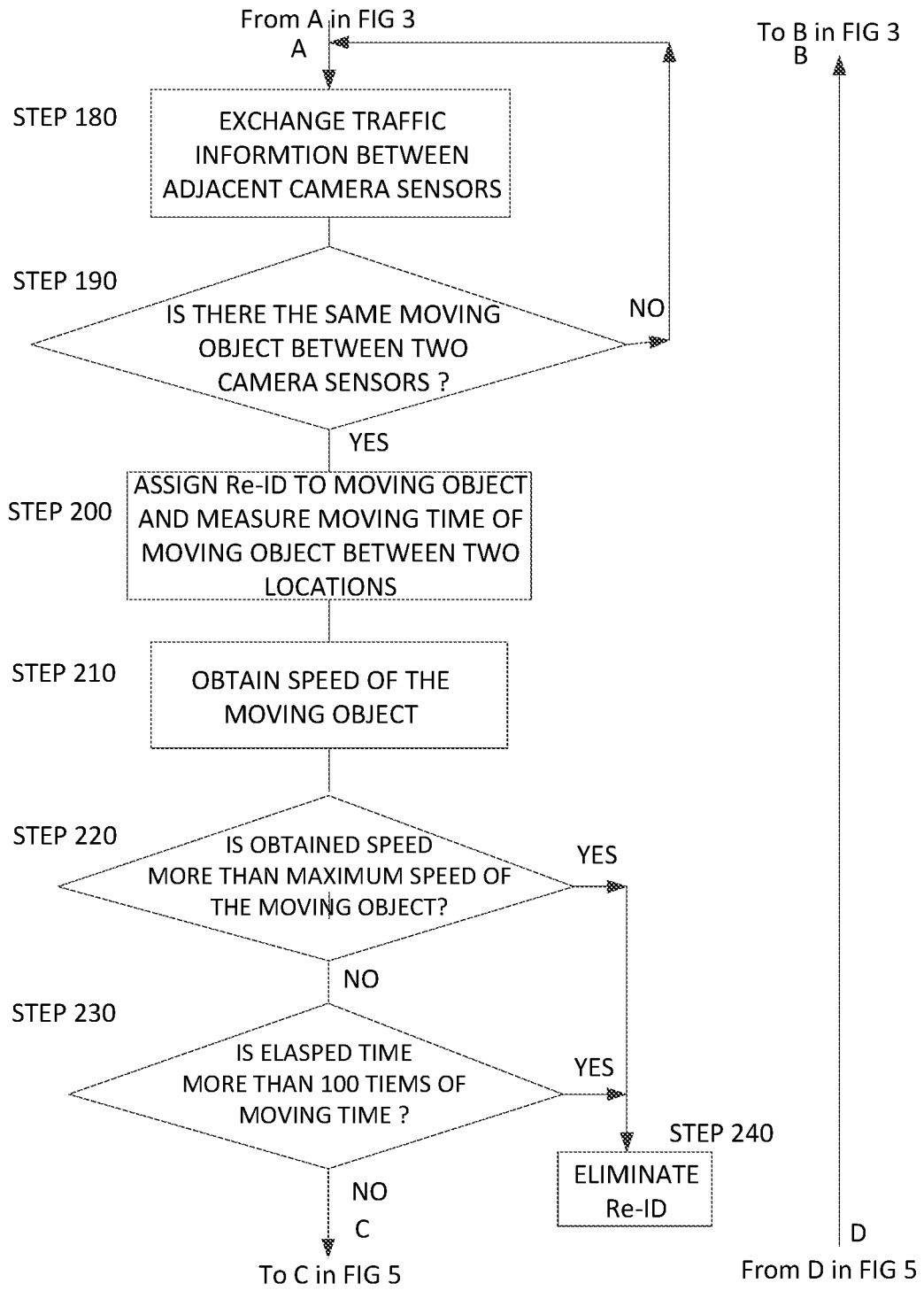
FIG. 4 illustrates a flowchart of computer programs running on CPUs on a camera sensor in a traffic system being continued from flowchart in FIG. 3.

FIG. 4 continues flowchart illustrated in FIG. 3. Computer programs, then, exchange traffic data including, traffic signal change timing, classified moving objects, color and shapes of moving objects, with adjacent camera sensors via mesh network 120 to share traffic information each other, STEP 180. An anonymous ID is given to each moving object captured by camera sensor 180, 182 or 184. Then, computer programs determine if there are the same moving object between two camera sensors, STEP 190. If the same moving object can be detected, computer programs assign Re-ID to both moving objects and measure a moving time of the moving object between two points where the two camera sensors are installed, STEP 200. Since distance between camera sensors is known, speed of the moving object can be obtained by using time stamps when the moving object has passed through two camera sensor locations, STEP 210.

Nest step, computer programs check the speed of the vehicle to see if the obtained speed is more than a maximum speed of the vehicle which can be known via classified models by makers and models, STEP 220. When the obtained speed is more than the maximum speed, then the computer programs eliminate the Re-ID because obtained speed data may be erroneous data, STEP 240. In next step, computer programs measure an elapsed time from the time when the Re-ID was given to the vehicle to the current time when the moving time is obtained. When measured elapsed time is more than the predetermined time being set less than 100 (a hundred) times of the travel time of the vehicle, STEP 230, then the computer programs eliminate the Re-ID, STEP 240. These processes are performed at each camera sensor so that Re-ID data which might include personal data can be protected from the public. Once computer programs have estimated the traffic signal change timing, computer programs are arranged to eliminate Re-ID after a predetermined time period so that it becomes possible to reduce the risk that Re-ID is disclosed to public.

Figure 5:
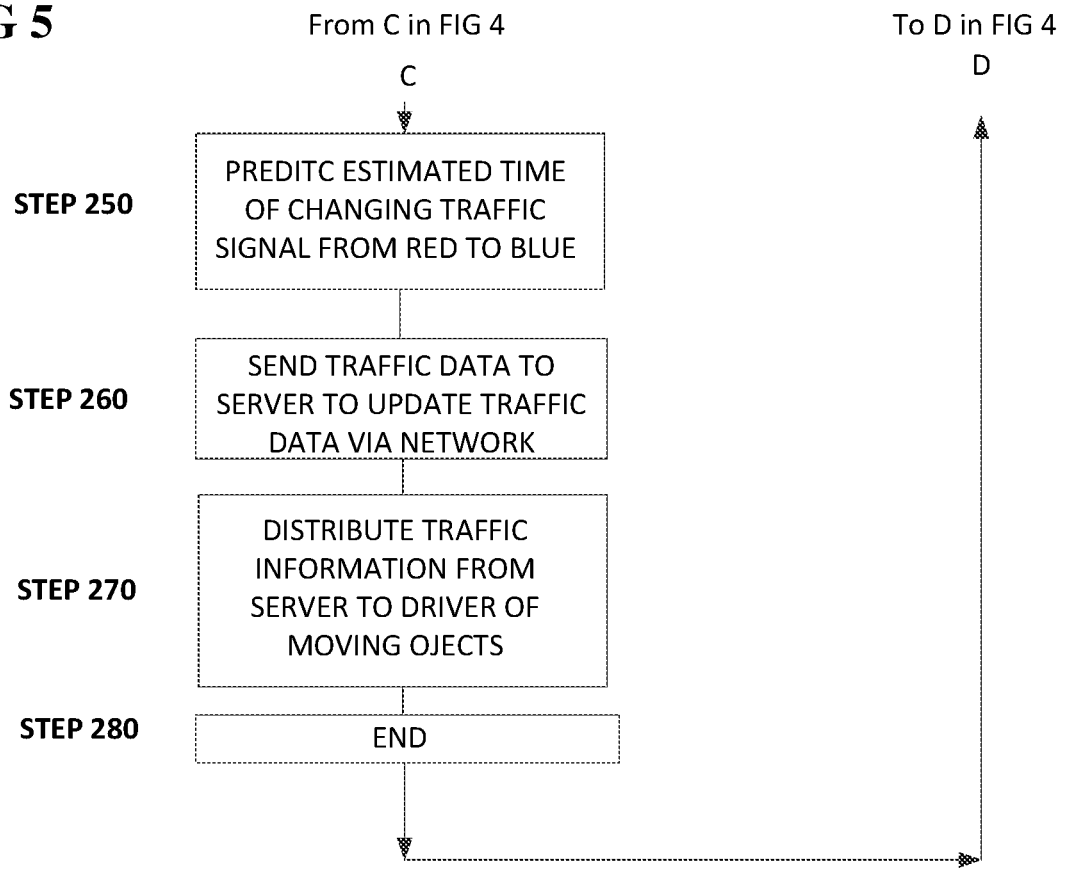
FIG. 5 illustrates a flowchart of computer programs running on CPUs on a camera sensor in a traffic system being continued from flowchart in FIG. 4.

Then computer programs estimate the time when traffic signal lights change, STEP 250, as illustrated in FIG. 5. Updated traffic information including updated traffic signal change timing may be sent to server 160 STEP 260. Then the updated traffic information may be distributed to drivers of the moving objects on each road lane from sever 160, STEP 270.

Effects of the Invention

The size of a camera sensor of an embodiment of the present invention has a small enough to attached to structure adjacent to existing traffic-lights. Accordingly, the camera sensor can be easily attached together currently existing traffic infrastructure traffic signal lights where the locations thereof are known. Accordingly moving time (speed) of the moving objects between camera sensors can be easily obtained using time stamps stored in each camera sensor. Then speeds of the moving objects can be obtained.

Further traffic routs of the moving objects can be traced and obtained by using Re-ID which can be useful for public traffic transportation agency for local governments.

As for traffic data transmission between camera sensors and servers, local P2P communication, mesh network and cloud server may be used. It is possible to set an upper limit of the time to store Re-ID based on the distance between camera sensors and the moving speed of the moving object so that information is not carelessly stored for a long time. As for this storage period, the data storage period may be automatically determined for each observation target object. The advantage is that the storage period can be optimized, and the memory size can be saved.

In realizing the Re-ID, not only information from images captured by cameras but also a sound sensor may be used as supplement information together with captured images so that more accurate traffic data can be obtained.

What is claimed is:

1. A traffic system for predicting a traffic signal switching timing, the traffic system comprising:

a camera sensor having a camera identification code (CID), the camera sensor comprising:

a) a camera for capturing images of traffic signal lights along a traffic lane and moving objects on the traffic lane;

b) a CPU for running computer programs for analyzing the images of the traffic signal lights and the moving objects to learn traffic signal switching timing, wherein the traffic signal switching timing includes time stamps when traffic signal changes from green to yellow, a yellow lighting time being a duration time of a yellow light, a red lighting time being a duration time of a red light and a green lighting time being a duration time of a green light of each the traffic signal lights;

c) a sound sensor for obtaining sound signals originated from the moving objects;

and d) a communication interface for sending and receiving data associated with the traffic signal switching timing with the camera identification code (CID) to/from other camera sensors; and a server for providing traffic information including the traffic signal switching timing to drivers of the moving objects, the sever being arranged to receive and send the data to/from the camera sensor.

2. The traffic system of claim 1, wherein, the server is arranged to store the camera identification code (CID), the time stamps when traffic light changes from green to yellow (Time Stamp), the yellow lighting time, the red lighting time, and the green lighting time.

3. The traffic system of claim 1, wherein the computer programs include a step for classifying the moving objects into a plurality of classes using shapes and color of the moving objects.

4. The traffic system of claim 3, wherein the computer programs further include a step for assigning the same identification code (Re-ID) to two moving objects when the classified classes, colors and shapes of the two moving objects on the captured images obtained by two camera sensors in different locations are determined to be the same or close enough.

5. The traffic system of claim 4, wherein the computer programs further include a step for obtaining a travel time of a moving object to which the Re-ID is given so that a speed of the moving object to which the Re-ID is given can be obtained using a distance between said two locations and the travel time of the moving object to which the Re-ID is given.

6. The traffic system of claim 1, wherein the camera further includes functions for capturing a loop coil installed on the road lane for sensing the moving objects to switch the traffic signal lights.

7. The traffic system of claim 5, wherein the computer programs further include a step for eliminating the Re-ID from the camera sensor before an elapsed time from a time when Re-ID assigned to the moving object to a current time when the moving time is obtained reaches to a predetermined time being set less than 100 (a hundred) times of the travel time of the moving object.

8. The traffic system of claim 1, wherein the computer programs further include a step for learning and memorizing features of sound signals originated from driving sources of the moving objects.

9. The traffic system of claim 8, wherein the computer program further includes a step for learning and memorizing features of sound signals originated from the driving sources of the moving objects under different kinds of weather conditions.

10. The traffic system of claim 8 wherein the computer programs include a step for analyzing and classifying engine types of the moving objects using the learned and memorized features of sound signals.

11. The traffic system of claim 5, wherein the computer programs further include a step for eliminating the Re-ID from the camera sensor when the speeds of the moving objects are more than a maximum speed of the moving objects.

12. The traffic system of claim 8 wherein the features of sound signals include either tire-audible-signals created between tires of the moving objects and a surface of the road lane, or sound signals including weather conditions, such as rain or snow or both of them.

* * * * *